US009564679B2

(12) United States Patent
Rho et al.

(10) Patent No.: US 9,564,679 B2
(45) Date of Patent: Feb. 7, 2017

(54) ANTENNA DEVICE AND MOBILE TERMINAL HAVING SAME

(71) Applicant: LG ELECTRONICS INC., Seoul (KR)

(72) Inventors: Sungjung Rho, Seoul (KR); Byungwoon Jung, Seoul (KR); Youngbae Kwon, Seoul (KR); Hanphil Rhyu, Seoul (KR); Changwon Yun, Seoul (KR); Duckyun Kim, Seoul (KR); Deuksu Choi, Seoul (KR); Jaewoo Lee, Seoul (KR); Sungjoon Hong, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 11 days.

(21) Appl. No.: 14/648,850

(22) PCT Filed: Aug. 6, 2013

(86) PCT No.: PCT/KR2013/007101
§ 371 (c)(1),
(2) Date: Jun. 1, 2015

(87) PCT Pub. No.: WO2015/020244
PCT Pub. Date: Feb. 12, 2015

(65) Prior Publication Data

US 2015/0340757 A1 Nov. 26, 2015

(30) Foreign Application Priority Data

Aug. 6, 2013 (KR) ..... 10-2013-0093223

(51) Int. Cl.
*H01Q 1/24* (2006.01)
*H01Q 9/42* (2006.01)
(Continued)

(52) U.S. Cl.
CPC ..... *H01Q 1/243* (2013.01); *H01Q 1/46* (2013.01); *H01Q 5/342* (2015.01); *H01Q 5/35* (2015.01); *H01Q 9/42* (2013.01); *H01Q 13/10* (2013.01)

(58) Field of Classification Search
None
See application file for complete search history.

(56) References Cited

U.S. PATENT DOCUMENTS

2008/0316115 A1* 12/2008 Hill ..... H01Q 1/243 343/702
2009/0015507 A1* 1/2009 Hong ..... H01Q 1/1207 343/873
(Continued)

FOREIGN PATENT DOCUMENTS

KR 10-2008-0097824 A 11/2008
KR 10-2013-0012577 A 2/2013
(Continued)

*Primary Examiner* — Robert Karacsony
(74) *Attorney, Agent, or Firm* — Birch, Stewart, Kolasch & Birch, LLP

(57) ABSTRACT

An antenna apparatus according to one exemplary embodiment disclosed herein includes a first member and a second member limiting a slot, a feeding unit provided on one surface of a carrier covering the slot and configured to feed the slot, and a first radiator formed on the one surface of the carrier with being spaced apart from the feeding unit, and electrically connected to the first member, the first radiator configured to resonate together with the slot at a first frequency band and a second frequency band.

22 Claims, 9 Drawing Sheets

(51) Int. Cl.

| | |
|---|---|
| ***H01Q 5/342*** | (2015.01) |
| ***H01Q 5/35*** | (2015.01) |
| ***H01Q 13/10*** | (2006.01) |
| ***H01Q 1/46*** | (2006.01) |

(56) References Cited

U.S. PATENT DOCUMENTS

| | | | |
|---|---|---|---|
| 2010/0214181 | A1 | 8/2010 | Ryou et al. |
| 2012/0046002 | A1 | 2/2012 | Hill et al. |
| 2013/0027254 | A1 | 1/2013 | Korva et al. |
| 2013/0050038 | A1 | 2/2013 | Eom et al. |

FOREIGN PATENT DOCUMENTS

| | | | |
|---|---|---|---|
| KR | 10-2013-0022203 | A | 3/2013 |
| WO | WO 2007/084051 | A1 | 7/2007 |

* cited by examiner

ANTENNA DEVICE AND MOBILE TERMINAL HAVING SAME

CROSS REFERENCE TO RELATED APPLICATIONS

This application is the National Phase of PCT International Application No. PCT/KR2013/007101, filed on Aug. 6, 2013, which claims priority under 35 U.S.C. 119(a) to Patent Application No. 10-2013-0093223, filed in the Republic of Korea on Aug. 6, 2013, all of which are hereby expressly incorporated by reference into the present application.

TECHNICAL FIELD

The present disclosure relates to a mobile terminal having an antenna apparatus capable of transmitting and receiving wireless signals.

BACKGROUND ART

Mobile terminals are electronic devices which are portable and have at least one of voice and telephony call functions, information input and/or output functions, a data storage function and the like.

As it becomes multifunctional, the mobile terminal can be allowed to capture still images or moving images, play music or video files, play games, receive broadcast and the like, so as to be implemented as an integrated multimedia player.

Many efforts are undergoing to support and enhance various functions as such multimedia player in view of hardware or software improvements. As one example, a user interface environment is provided in order for users to easily and conveniently retrieve or select functions.

In addition to those efforts, a method for more improving functions of a mobile terminal may be taken into account. The improvement method may include structural changes and improvements for more facilitating a user to use the mobile terminal. As one of the structural changes and improvements, an antenna for transmitting and receiving electric waves may be taken into account.

An antenna is a device which is configured to transmit and receive radio electromagnetic waves for wireless communication and is an essential constituting element for a mobile terminal. Recently, users hold in a great account designs of mobile terminals, specifically, desire to use mobile terminals which have a larger display as well as being conveniently portable. Hence, manufacturers of mobile terminals are trying hard to develop techniques for producing a bezel with the least size. This, however, brings about the gradual reduction of the size of the antenna. Also, telecommunications operators are gradually expanding superhigh-speed data services from conventional 2G/3G voice/data services to 4G LTE/LTE-A services. This is not the trend that limitedly happens simply in several countries. Therefore, in designing mobile terminals, it should be considered to cover various frequency bands of various telecommunications operators in the world. This means that the number of frequency bands to cover in mobile terminals should increase much more than the conventional mobile terminals, and also means that an antenna space should innovatively be reduced in keeping with the aforementioned consumers' design trend. Therefore, studies on an antenna having a new structure providing satisfactory efficiency in a smaller space are actively undergoing.

SUMMARY OF THE INVENTION

Therefore, an aspect of the detailed description is to provide a mobile terminal having an antenna apparatus, capable of transmitting and receiving radio electromagnetic waves of a multi-frequency band.

Another aspect of the detailed description is to provide a mobile terminal having an antenna apparatus, which is more reduced in size with providing better efficiency.

To achieve these and other advantages and in accordance with the purpose of the present invention, as embodied and broadly described herein, there is provided an antenna apparatus including a first member and a second member limiting a slot, a feeding unit provided on one surface of a carrier covering the slot and configured to feed the slot, and a first radiator formed on the one surface of the carrier with being spaced apart from the feeding unit, electrically connected to the first member, and configured to resonate together with the slot at a first frequency band and a second frequency band.

In accordance with one embodiment disclosed herein, one side of the slot may be open.

In accordance with one embodiment disclosed herein, the first radiator may include a first part having at least part in parallel to the slot, and a second part having at least part intersecting with the slot.

In accordance with one embodiment disclosed herein, the length of the slot may correspond to 0.15λ of a center frequency (λ) of the first frequency band.

In accordance with one embodiment disclosed herein, one side of the feeding unit may be inserted through the carrier to be connected to a contact portion that is connected to a feeding line, and the other side thereof may be inserted through the carrier to be connected to the first member.

In accordance with one embodiment disclosed herein, the first member may be configured as a dielectric having upper and lower surfaces. The first member may be provided with contact portions on the upper surface that is covered by the carrier. The first member may be provided with a conductive plate on the lower surface.

In accordance with one embodiment disclosed herein, one of the contact portions may be connected to the feeding unit.

In accordance with one embodiment disclosed herein, one of the contact portions may be connected to the first radiator.

In accordance with one embodiment disclosed herein, the antenna apparatus may further include a second radiator branched off from the feeding unit such that the antenna apparatus additionally resonates at a third frequency band.

In accordance with one embodiment disclosed herein, at least part of the second radiator may be in parallel to the feeding unit.

To achieve these and other advantages and in accordance with the purpose of the present invention, as embodied and broadly described herein, there is provided a mobile terminal including a terminal body, and a first antenna apparatus and a second antenna apparatus provided on one side of the terminal body with being isolated from each other. The first antenna apparatus may include a first member and a second member limiting a slot, a feeding unit provided on one surface of a carrier covering the slot and configured to feed the slot, and a first radiator formed on the one surface of the carrier with being spaced apart from the feeding unit, and electrically connected to the first member, the first radiator configured to resonate together with the slot at a first frequency band and a second frequency band.

In accordance with one embodiment disclosed herein, the second antenna apparatus may be implemented as a planar inverted F antenna (PIFA) type antenna.

In accordance with one embodiment disclosed herein, the first antenna apparatus may generally radiate transverse magnetic waves and the second antenna apparatus may generally radiate transverse electric waves.

In accordance with one embodiment disclosed herein, the first and second members may be conductive members provided on the terminal body, respectively.

In accordance with one embodiment disclosed herein, the first radiator may include a first part having at least part in parallel to the slot, and a second part having at least part intersecting with the slot.

In accordance with one embodiment disclosed herein, one side of the feeding unit may be inserted through the carrier to be connected to a contact portion that is connected to a feeding line, and the other side thereof may be inserted through the carrier to be connected to the first member.

In accordance with one embodiment disclosed herein, the first member may be configured as a dielectric having upper and lower surfaces. The first member may be provided with contact portions on the upper surface that is covered by the carrier. The first member may be provided with a conductive plate on the lower surface.

In accordance with one embodiment disclosed herein, one of the contact portions may be connected to the feeding unit.

In accordance with one embodiment disclosed herein, one of the contact portions may be connected to the first radiator.

In accordance with one embodiment disclosed herein, the contact portions may be electrically connected to the conductive plates through via holes formed through the first member.

In accordance with one embodiment disclosed herein, the first antenna apparatus may further include a second radiator branched off from the feeding unit such that the first antenna apparatus additionally resonates at a third frequency band.

In accordance with one embodiment disclosed herein, at least part of the second radiator may be in parallel to the feeding unit.

In accordance with one embodiment disclosed herein, the second member may be a flexible printed circuit board that is mounted in the terminal body and configured to transfer signals input and output through a socket, which allows for an access with an external device, to a controller.

In accordance with one embodiment disclosed herein, the mobile terminal may further include a conductive frame that is mounted in the terminal body and configured to support an inside of the terminal body. The conductive plate and the conductive frame may be electrically connected to each other.

In accordance with the detailed description, an antenna apparatus for a mobile terminal in accordance with at least one exemplary embodiment disclosed herein can exhibit sufficient performance by use of a slot with a shorter length. With such antenna apparatus built-in the mobile terminal, a mounting space for other components can be ensured, thereby reducing a size of the mobile terminal.

Also, a first antenna apparatus can be provided with a slot and a second antenna apparatus can be implemented into a planar inverted F antenna (PIFA) type antenna, which may result in providing a mobile terminal meeting an antenna to antenna isolation of −15 dB or less even though the antennas are adjacent to each other.

DETAILED DESCRIPTION OF THE EMBODIMENTS

Description will now be given in detail of a mobile terminal according to the exemplary embodiments disclosed herein, with reference to the accompanying drawings. A suffix "module" and "unit" used for constituent elements disclosed in the following description is merely intended for easy description of the specification, and the suffix itself does not give any special meaning or function.

Mobile terminals described herein may include cellular phones, smart phones, laptop computers, digital broadcasting terminals, personal digital assistants (PDAs), portable multimedia players (PMPs), navigators, and the like.

Figure 1:
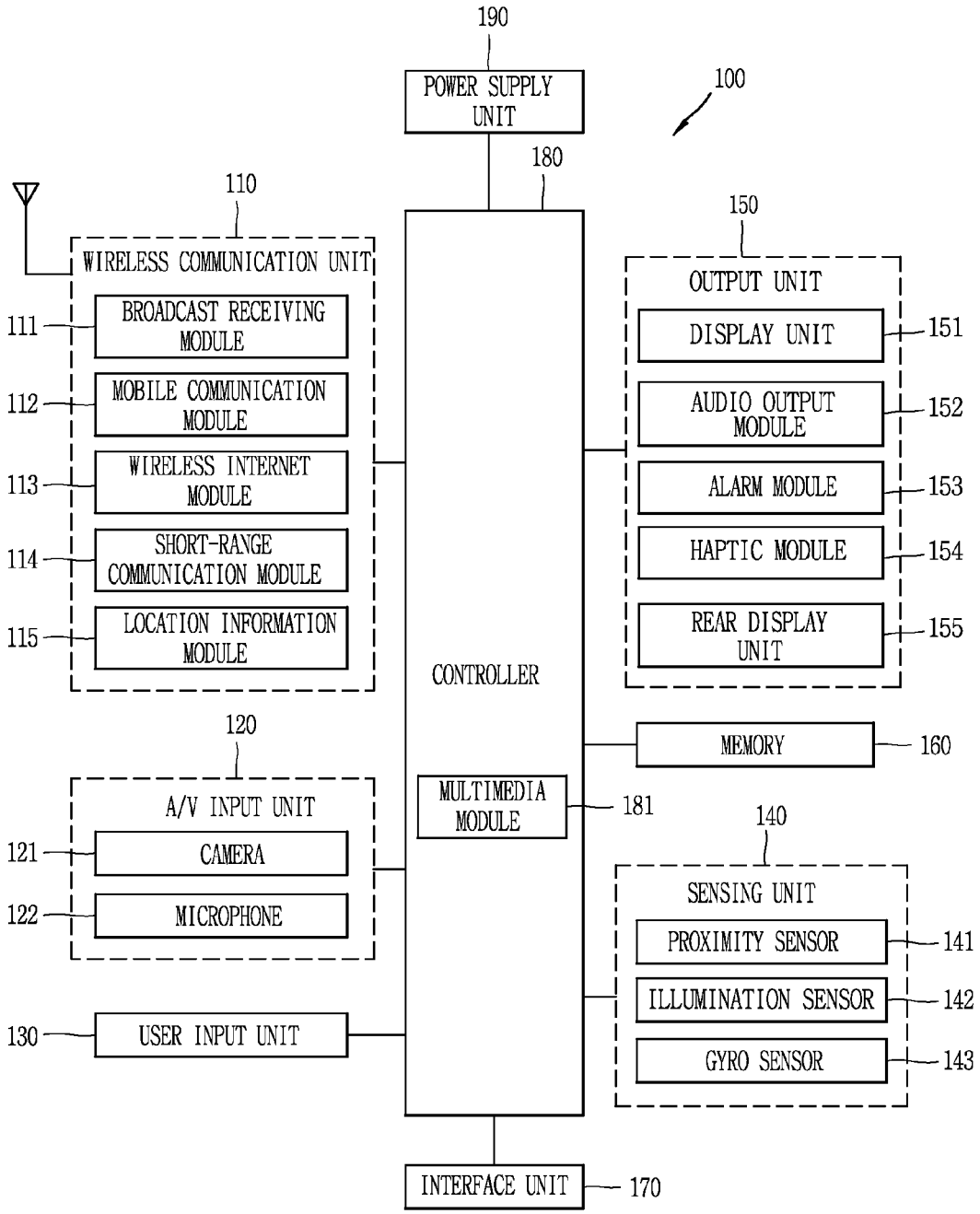
FIG. 1 is a block diagram of a mobile terminal in accordance with one exemplary embodiment of the present invention.

FIG. 1 is a block diagram illustrating a mobile terminal associated with an exemplary embodiment.

The mobile terminal 100 may include a wireless communication unit 110, an Audio/Video (A/V) input unit 120, a user input unit 130, a sensing unit 140, an output unit 150, a memory 160, an interface unit 170, a controller 180, a power supply unit 190, and the like. However, all of the elements as illustrated in FIG. 1 are not necessarily required, and the mobile terminal may be implemented with greater or less number of elements than those illustrated elements.

Hereinafter, the constituent elements will be described in turn.

The wireless communication unit 110 may include one or more modules which permit wireless communications between the terminal 100 and a wireless communication system, communications between the terminal 100 and a network in which the terminal 100 is located. The wireless communication unit 110 may include one or more of a broadcast receiving module 111, a mobile communication module 112, a wireless Internet module 113, a short-range communication module 114, and a location information module 115.

The broadcast receiving module 111 receives a broadcast signal and/or broadcast associated information from an external broadcast managing entity via a broadcast channel.

The broadcast channel may include a satellite channel and/or a terrestrial channel. The broadcast management server may be a server that generates and transmits a broadcast signal and/or broadcast associated information or a server that receives a previously generated broadcast signal and/or broadcast associated information and transmits the same to a terminal. The broadcast signal may include a TV broadcast signal, a radio broadcast signal, a data broadcast signal, and the like. Also, the broadcast signal may further include a broadcast signal combined with a TV or radio broadcast signal.

The broadcast associated information may refer to information associated with a broadcast channel, a broadcast program or a broadcast service provider. The broadcast associated information may also be provided via a mobile communication network and, in this case, the broadcast associated information may be received by the mobile communication module 112.

The broadcast signal may exist in various forms. For example, it may exist in the form of an electronic program guide (EPG) of a digital multimedia broadcasting (DMB) system, an electronic service guide (ESG) of a digital video broadcast-handheld (DVB-H) system, and the like.

The broadcast receiving module 111 may receive a digital broadcast by using a digital broadcast system such as a multimedia broadcasting-terrestrial (DMB-T) system, a digital multimedia broadcasting-satellite (DMB-S) system, a data broadcasting system such as media forward link only (MediaFLO®), a digital video broadcast-handheld (DVB-H) system, integrated services digital broadcast-terrestrial (ISDB-T), etc. The broadcast receiving module 111 may be configured to be suitable for additional broadcast systems that provide a broadcast signal as well as the above-mentioned digital broadcast systems.

Broadcast signals and/or broadcast-associated information received via the broadcast receiving module 111 may be stored in the memory 160.

The mobile communication module 112 may transmit/receive wireless signals to/from at least one of network entities (e.g., base station, an external terminal, a server, etc.) on a mobile communication network. Here, the wireless signals may include audio call signal, video call signal, or various formats of data according to transmission/reception of text/multimedia messages.

The wireless Internet module 113 is a module which supports wireless Internet access for the terminal. This module may be internally or externally coupled to the mobile terminal. Examples of such wireless Internet access may include Wireless LAN (WLAN), Wi-Fi, Wireless Broadband (Wibro), World Interoperability for Microwave Access (Wimax), High Speed Downlink Packet Access (HSDPA), and the like.

The short-range communication module 114 denotes a module for short-range communications. Suitable technologies for implementing this module may include BLUETOOTH, Radio Frequency IDentification (RFID), Infrared Data Association (IrDA), Ultra-WideBand (UWB), ZigBee, and the like.

The location information module 115 denotes a module for detecting or calculating a position of the terminal. An example of the location information module 115 may include a Global Position System (GPS) module.

Referring to FIG. 1, the A/V input unit 120 is configured to provide audio or video signal input to the terminal. The A/V input unit 120 may include a camera 121 and a microphone 122. The camera 121 receives and processes image frames of still pictures or video obtained by image sensors in a video call mode or a capturing mode. The processed image frames may be displayed on a display unit 151 and/or a rear display unit 155.

The image frames processed by the camera 121 may be stored in the memory 160 or transmitted to the exterior via the wireless communication unit 110. Two or more cameras 121 may be provided according to the configuration of the terminal.

The microphone 122 may receive an external audio signal via a microphone while the terminal is in a particular mode, such as a phone call mode, a recording mode, a voice recognition mode, or the like. This audio signal is processed into electric audio data. The processed digital data is converted for output into a format transmittable to a mobile communication base station via the mobile communication module 112 in case of the phone call mode. The microphone 122 may include assorted noise removing algorithms to remove noise generated in the course of receiving the external audio signal.

The user input unit 130 may generate input data inputted by a user to control the operation of the terminal. The user input unit 130 may include a keypad, a dome switch, a touchpad (e.g., static pressure/capacitance), a jog wheel, a jog switch and the like.

The sensing unit 140 may provide status measurements of various aspects of the terminal. For instance, the sensing unit 140 may detect an open/close status of the terminal, a change in a location of the terminal 100, a presence or absence of user contact with the terminal 100, the location of the terminal 100, acceleration/deceleration of the terminal 100, and the like, so as to generate a sensing signal for controlling the operation of the terminal 100. For example, regarding a slide-type terminal, the sensing unit 140 may sense whether a sliding portion of the terminal is open or closed. Other examples include sensing functions, such as the sensing unit 140 sensing the presence or absence of power provided by the power supply 190, the presence or absence of a coupling or other connection between the interface unit 170 and an external device, and the like. Meanwhile, the sensing unit 140 may include a proximity sensor 141.

The output unit 150 is configured to output an audio signal, a video signal or an alarm signal. The output unit 150 may include a front display unit 151, an audio output module 152, an alarm 153, a haptic module 154 and the like.

The front display unit 151 may output information processed in the terminal 100. For example, when the terminal is operating in a phone call mode, the front display unit 151 may provide a User Interface (UI) or a Graphic User Interface (GUI), which includes information associated with the call. As another example, if the terminal is in a video call mode or a capture mode, the front display unit 151 may additionally or alternatively display images captured and/or received, UI, or GUI.

The front display unit 151 may be implemented using, for example, at least one of a Liquid Crystal Display (LCD), a Thin Film Transistor-Liquid Crystal Display (TFT-LCD), an Organic Light-Emitting Diode (OLED), a flexible display, a three-dimensional (3D) display, an e-ink display and the like.

Some of such displays may be implemented as a transparent type or an optical transparent type through which the exterior is visible, which is referred to as a transparent display. A representative example of the transparent display may include a Transparent OLED (TOLED), or the like. The rear surface of the front display unit 151 may also be implemented to be optically transparent. Under this configuration, a user can view an object positioned at a rear side of a terminal body through a region occupied by the front display unit 151 of the terminal body.

The front display unit 151 may be implemented in two or more in number according to a configured aspect of the terminal 100. For instance, a plurality of the front display units 151 may be arranged on one surface to be spaced apart from or integrated with each other, or may be arranged on different surfaces.

Here, if the front display unit 151 and a touch sensitive sensor (referred to as a 'touch sensor') have a layered structure therebetween (referred to as a 'touch screen'), the front display unit 151 may be used as an input device as well as an output device. The touch sensor may be implemented as a touch film, a touch sheet, a touchpad, and the like.

The touch sensor may be configured to convert changes of pressure applied to a specific part of the display unit 151, or a capacitance occurring from a specific part of the display unit 151, into electric input signals. Also, the touch sensor may be configured to sense not only a touched position and a touched area, but also touch pressure.

When touch inputs are sensed by the touch sensors, corresponding signals may be transmitted to a touch controller. The touch controller may process the received signals, and then transmit corresponding data to the controller 180. Accordingly, the controller 180 may sense which region of the display unit 151 has been touched.

Still referring to FIG. 1, a proximity sensor 141 may be arranged at an inner region of the terminal covered by the touch screen, or near the touch screen. The proximity sensor 141 refers to a sensor to sense presence or absence of an object approaching to a surface to be sensed, or an object disposed near a surface to be sensed, by using an electromagnetic field or infrared rays without a mechanical contact. The proximity sensor 141 may have a longer lifespan and a more enhanced utility than a contact sensor.

The proximity sensor 141 may include a transmissive type photoelectric sensor, a direct reflective type photoelectric sensor, a mirror reflective type photoelectric sensor, a high-frequency oscillation proximity sensor, a capacitance type proximity sensor, a magnetic type proximity sensor, an infrared rays proximity sensor, and so on. When the touch screen is implemented as a capacitance type, proximity of a pointer to the touch screen may be sensed by changes of an electromagnetic field. In this case, the touch screen (touch sensor) may be categorized into a proximity sensor.

Hereinafter, for the sake of brief explanation, a status that the pointer is positioned to be proximate onto the touch screen without contact will be referred to as 'proximity touch', whereas a status that the pointer substantially comes in contact with the touch screen will be referred to as 'contact touch'. For the position corresponding to the proximity touch of the pointer on the touch screen, such position will correspond to a position where the pointer faces perpendicular to the touch screen upon the proximity touch of the pointer.

The proximity sensor 141 may sense proximity touch, and proximity touch patterns (e.g., distance, direction, speed, time, position, moving status, etc.). Information relating to the sensed proximity touch and the sensed proximity touch patterns may be output onto the touch screen.

The audio output module 152 may output audio data received from the wireless communication unit 110 or stored in the memory 160 in a call signal reception mode, a call mode, a record mode, a voice recognition mode, a broadcast reception mode, and the like. Also, the audio output module 152 may provide audible output signals related to a particular function (e.g., a call signal reception sound, a message reception sound, etc.) performed by the terminal 100. The audio output module 152 may include a receiver, a speaker, a buzzer or the like.

The alarm unit 153 may output a signal for informing about an occurrence of an event of the terminal 100. Events generated in the terminal, for example, may include call signal reception, message reception, key signal inputs, a touch input, etc. In addition to video or audio signals, the alarm unit 153 may output signals in a different manner, for example, using vibration to inform of an occurrence of an event. The video or audio signals may also be output via the front display unit 151 and the audio output module 152. Hence, the front display unit 151 and the audio output module 152 may be classified as parts of the alarm unit 153.

A haptic module 154 may generate various tactile effects that user may feel. A typical example of the tactile effect generated by the haptic module 154 is vibration. Strength, pattern and the like of the vibration generated by the haptic module 154 may be controllable by a user selection or setting of the controller. For example, different vibrations may be combined to be outputted or sequentially outputted.

Besides vibration, the haptic module 154 may generate various other tactile effects, including an effect by stimulation such as a pin arrangement vertically moving with respect to a contact skin, a spray force or suction force of air through a jet orifice or a suction opening, a touch on the skin, a contact of an electrode, electrostatic force, etc., an effect by reproducing the sense of cold and warmth using an element that can absorb or generate heat, and the like.

The haptic module 154 may be implemented to allow the user to feel a tactile effect through a muscle sensation such as the user's fingers or arm, as well as transferring the tactile effect through a direct contact. Two or more haptic modules 154 may be provided according to the configuration of the terminal 100.

The rear surface of the mobile terminal 100 is shown having a rear display unit 155 corresponding to the front display unit 151. The rear display unit 155 may be configured to have a relatively smaller size than the front display unit 151 and display relatively simple information.

The memory 160 may store programs used for operations performed by the controller, or may temporarily store input and/or output data (for example, a phonebook, messages, still images, video, etc.). In addition, the memory 160 may store data regarding various patterns of vibrations and audio signals output when a touch input is sensed on the touch screen.

The memory 160 may include at least one type of storage medium including a Flash memory, a hard disk, a multimedia card micro type, a card-type memory (e.g., SD or DX memory, etc), a Random Access Memory (RAM), a Static Random Access Memory (SRAM), a Read-Only Memory (ROM), an Electrically Erasable Programmable Read-Only Memory (EEPROM), a Programmable Read-Only memory (PROM), a magnetic memory, a magnetic disk, and an optical disk. Also, the terminal 100 may be operated in relation to a web storage device that performs the storage function of the memory 160 over the Internet.

The interface unit 170 may serve as an interface with every external device connected with the terminal 100. For example, the interface unit 170 may receive data transmitted from an external device, receive power to transfer to each element within the terminal 100, or transmit internal data of the terminal 100 to an external device. For example, the interface unit 170 may include wired or wireless headset ports, external power supply ports, wired or wireless data ports, memory card ports, ports for connecting a device having an identification module, audio input/output (I/O) ports, video I/O ports, earphone ports, or the like.

The identification module may be a chip that stores various information for authenticating authority of using the terminal 100 and may include a user identity module (UIM), a subscriber identity module (SIM), a universal subscriber identity module (USIM), and the like. In addition, the device having the identification module (referred to as 'identifying device', hereinafter) may take the form of a smart card. Accordingly, the identifying device may be connected with the terminal 100 via a port.

When the terminal 100 is connected with an external cradle, the interface unit 170 may serve as a passage to allow power from the cradle to be supplied to the terminal 100 therethrough or may serve as a passage to allow various command signals input by the user from the cradle to be transferred to the terminal therethrough. Various command signals or power input from the cradle may operate as signals for recognizing that the terminal is properly mounted on the cradle.

The controller 180 may typically control the general operations of the terminal 100. For example, the controller 180 may perform controlling and processing associated with voice calls, data communications, video calls, and the like. The controller 180 may include a multimedia module 181 for playbacking multimedia data. The multimedia module 181 may be configured within the controller 180 or may be configured to be separated from the controller 180.

The controller 180 may perform pattern recognition processing to recognize a handwriting input or a picture drawing input performed on the touch screen as characters or images, respectively.

The power supply unit 190 may receive external power or internal power and supply appropriate power required for operating respective elements and components under the control of the controller 180.

Various embodiments described herein may be implemented in a computer-readable or its similar medium using, for example, software, hardware, or any combination thereof.

For hardware implementation, the embodiments described herein may be implemented by using at least one of Application Specific Integrated Circuits (ASICs), Digital Signal Processors (DSPs), Digital Signal Processing Devices (DSPDs), Programmable Logic Devices (PLDs), Field Programmable Gate Arrays (FPGAs), processors, controllers, micro-controllers, microprocessors, and electronic units designed to perform the functions described herein. In some cases, such embodiments may be implemented by the controller 180 itself.

For software implementation, the embodiments such as procedures or functions described herein may be implemented by separate software modules. Each software module may perform one or more functions or operations described herein. Software codes can be implemented by a software application written in any suitable programming language. The software codes may be stored in the memory 160 and executed by the controller 180.

Considering the user input unit 130 again, the user input unit 130 disclosed herein may be provided on the rear surface of the terminal such that the front display can have a larger screen. Hereinafter, a detailed structure that the user input unit 130 is disposed on the rear surface of the terminal and operations implemented thereby will be described in more detail.

Figure 2A:
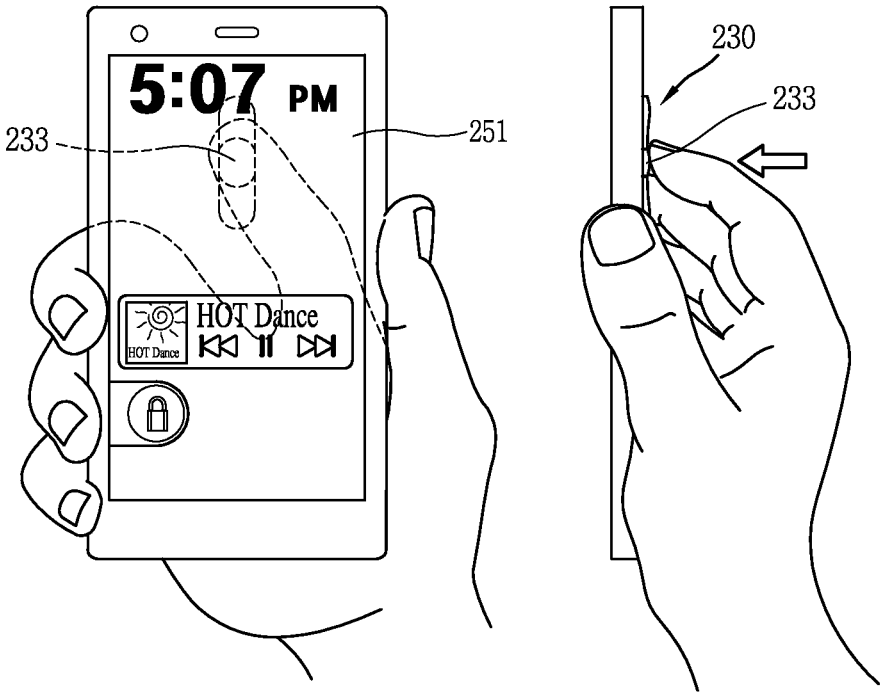
FIGS. 2A and 2B are conceptual views illustrating operations implemented in accordance with one exemplary embodiment of the present invention.
Figure 2B:
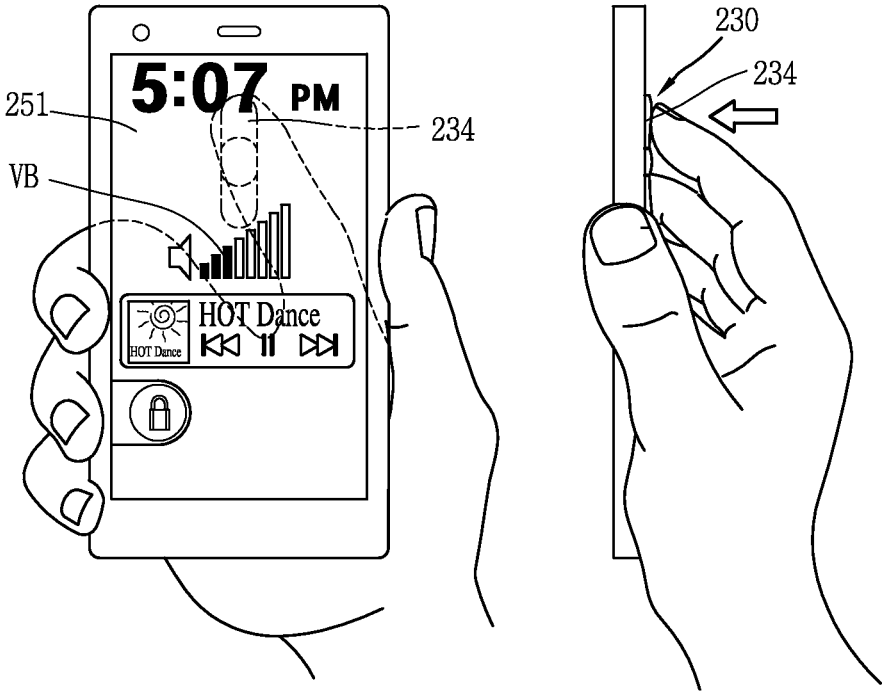

FIGS. 2A and 2B are conceptual views illustrating operations implemented in accordance with one exemplary embodiment of the present invention.

As illustrated in FIG. 2A, the terminal includes a display unit 251 disposed on one surface, for example, the front surface of the terminal main body. The display unit 251 may output a graphic user interface (GUI) of a currently-executed application. In order to allow a touch input to be applied to the GUI, the display unit 251 may be provided with a touch sensor to sense a touch input. The display unit 251 may output visual information configured in the form of an image, text, icon and the like, such as the GUI, but converted into an inactive state after a lapse of a predetermined time or in response to an input of a specific control command. FIG. 2A exemplarily illustrates such state, namely, the inactive state of the display unit 251 during an execution of a music playback application/

A rear input unit 230 is disposed on another surface, for example, a rear surface of the main body. The rear input unit 230 receives a control command for the display unit 251. In more detail, when a push input is applied to a button 233 of the rear input unit 230, the display unit 251 is converted into an active state. That is, the rear input unit 230 may function as a power key for turning on or off the display unit 251. Hence, the power-on/off of the terminal may also be performed by the button 233. As illustrated, a GUI of the music playback application is output in response to the activation of the display unit 251.

Referring to FIG. 2B, when a push button is applied to another button 232 of the rear input unit 230 in the state of FIG. 2A, a volume bar (VB) is output to allow for adjustment of a volume by manipulating the another button 232. Here, the present invention may not be limited to the process, but the push input applied to the another button 232 of the rear input unit 230 may also be an input for adjusting the volume in the state of FIG. 2A.

According to the example, the user can input a control command to the rear surface of the terminal in a pushing manner while viewing the display unit 251. Consequentially, the rear input unit on the rear surface of the terminal may be configured to receive a push input, and in some cases, may function as a power key and a volume key of the terminal.

Figure 3A:
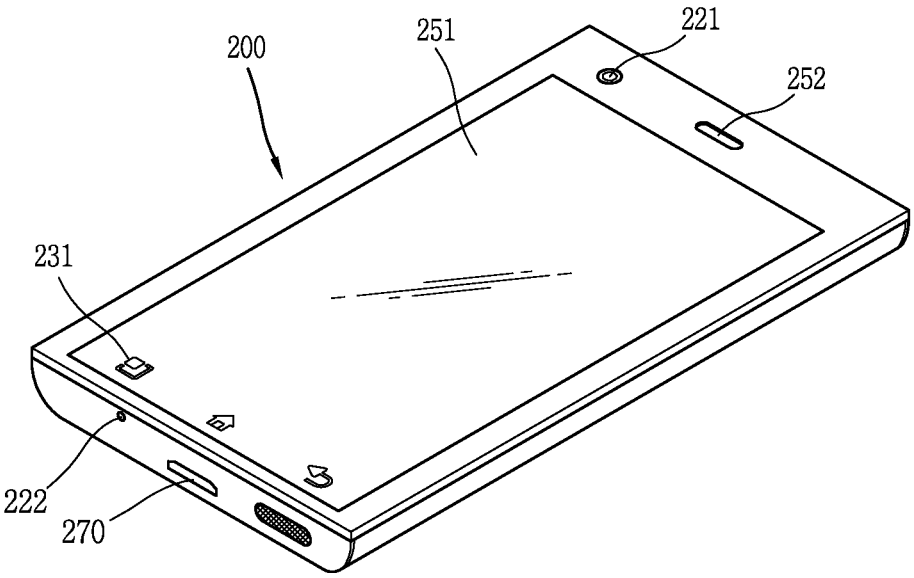
FIG. 3A is a front perspective view of one example of a mobile terminal in accordance with the present invention.
Figure 3B:
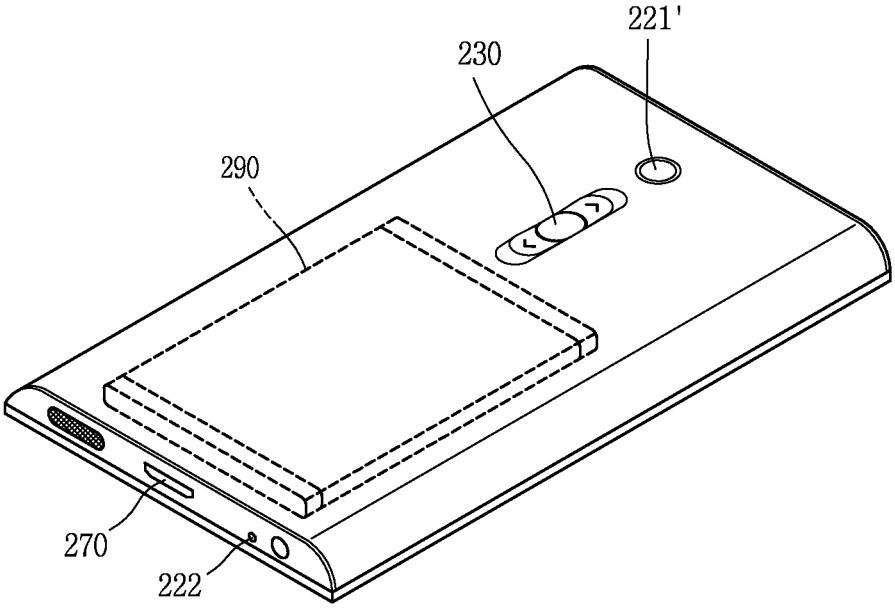
FIG. 3B is a rear perspective view of the mobile terminal illustrated in FIG. 3A.

Hereinafter, the hardware configuration of the terminal which performs the operations illustrated in the FIGS. 2A and 2B will be described in more detail. FIG. 3A is a front perspective view of one example of a mobile terminal in accordance with the present invention. FIG. 3B is a rear perspective view of the mobile terminal illustrated in FIG. 3A.

The mobile terminal 100 is described with reference to a bar-type terminal body. However, the mobile terminal 100 may alternatively be implemented in any of a variety of different configurations. Examples of such configurations include a slide-type, folder-type, swing-type, swivel-type and the like, in which two and more bodies are combined with each other in a relatively movable manner, and combinations thereof.

A body may include a case (or referred to as casing, housing, cover, etc.) defining an appearance of the mobile terminal. In this exemplary embodiment, the case may be divided into a front case 201 and a rear case 202 (see FIG. 4). A space formed between the front and rear cases 201 and 202 may accommodate various electronic components. At least one intermediate case may further be disposed between the front and the rear cases 201 and 202.

Such cases may be injected using a synthetic resin or be formed of a metal, such as stainless steel (STS), titanium (Ti) or the like.

The terminal body is shown having a display unit 251, an audio output module 252, a camera 221 and the like provided generally on the front case 201. Also, an interface unit 270, and the like may be disposed on side surfaces of the front case 201 and the rear case 202.

The display unit 251 may occupy most of a principal surface of the front case 201. That is, the display unit 251 may be disposed on a front surface of the terminal, and display visual information.

An audio output module 252 and a camera module 221 may be disposed on an area adjacent to one of both end portions of the display unit 251, and a front input unit 231 and a microphone 222 may be disposed on an area adjacent to the other end portion.

The front input unit 231 is an example of a user input unit 130 (see FIG. 1), and may include a plurality of manipulating units. The manipulating units may be referred to as a manipulating portion, and various methods and techniques can be employed for the manipulation portion so long as they can be operated by the user in a tactile manner. In accordance with this embodiment, the front input unit 231 is configured as a touch key. However, the present invention is not limited to this, the front input unit 231 may also include a push key.

The display unit 251 may also form a touch screen together with a touch sensor, and in this case, the touch screen may be the user input unit 130. This may allow for a configuration without a front input unit on the front surface of the terminal. For this, the mobile terminal may allow an input with respect to the main body to be manipulated only through the display unit 251 and a rear input unit 230 to be explained later.

Referring to FIG. 3B, a camera module 221' may additionally be disposed on the rear surface of the terminal body, namely, on the rear case 202. The camera module 221' may have an image capture direction which is substantially opposite to that of the camera module 221 (See FIG. 3A), and have a different number of pixels than the camera module 221.

For example, the camera module 221 may have a smaller number of pixels to capture an image of the user's face and transmit such image to another party, and the camera module 221' may have a larger number of pixels to capture an image of a general object and not immediately transmit it in most cases. The camera modules 221 and 221' may be installed on the terminal body such that they can be rotatable or popped up.

A flash and a mirror may be additionally disposed adjacent to the camera 221'. When an image of a subject is captured with the camera module 221', the flash illuminates the subject. The mirror allows the user to see himself when he wants to capture his own image (i.e., self-image capturing) by using the camera module 221'.

An audio output unit (not illustrated) may be additionally disposed on the rear surface of the terminal body. The audio output module on the rear surface may implement stereophonic sound functions in conjunction with the audio output module 252 (See FIG. 3A) and may be also used for implementing a speaker phone mode for call communication.

A power supply unit 290 for supplying power to the mobile terminal 200 is mounted on the terminal body. The power supply unit 290 may be installed within the terminal body or may be directly attached to or detached from the exterior of the terminal body.

As illustrated, a rear input unit 230 may be disposed on the rear surface of the terminal body. The rear input unit 230, for example, may be located below the camera module 221'.

The rear input unit 230 may be manipulated for allowing an input of a command for controlling an operation of the mobile terminal 200. Content inputted can be variably set. For example, the rear input unit 230 may receive a command such as starting, ending, scrolling, etc., a command such as controlling of the volume of a sound outputted from the audio output unit 252, or conversion into a touch recognition mode of the display unit 251.

The rear input unit 230 disclosed herein is implemented to receive a push input. In more detail, the rear input unit 230 may be configured as a mechanical or physical button which is a relative concept to the touch screen.

Figure 4:
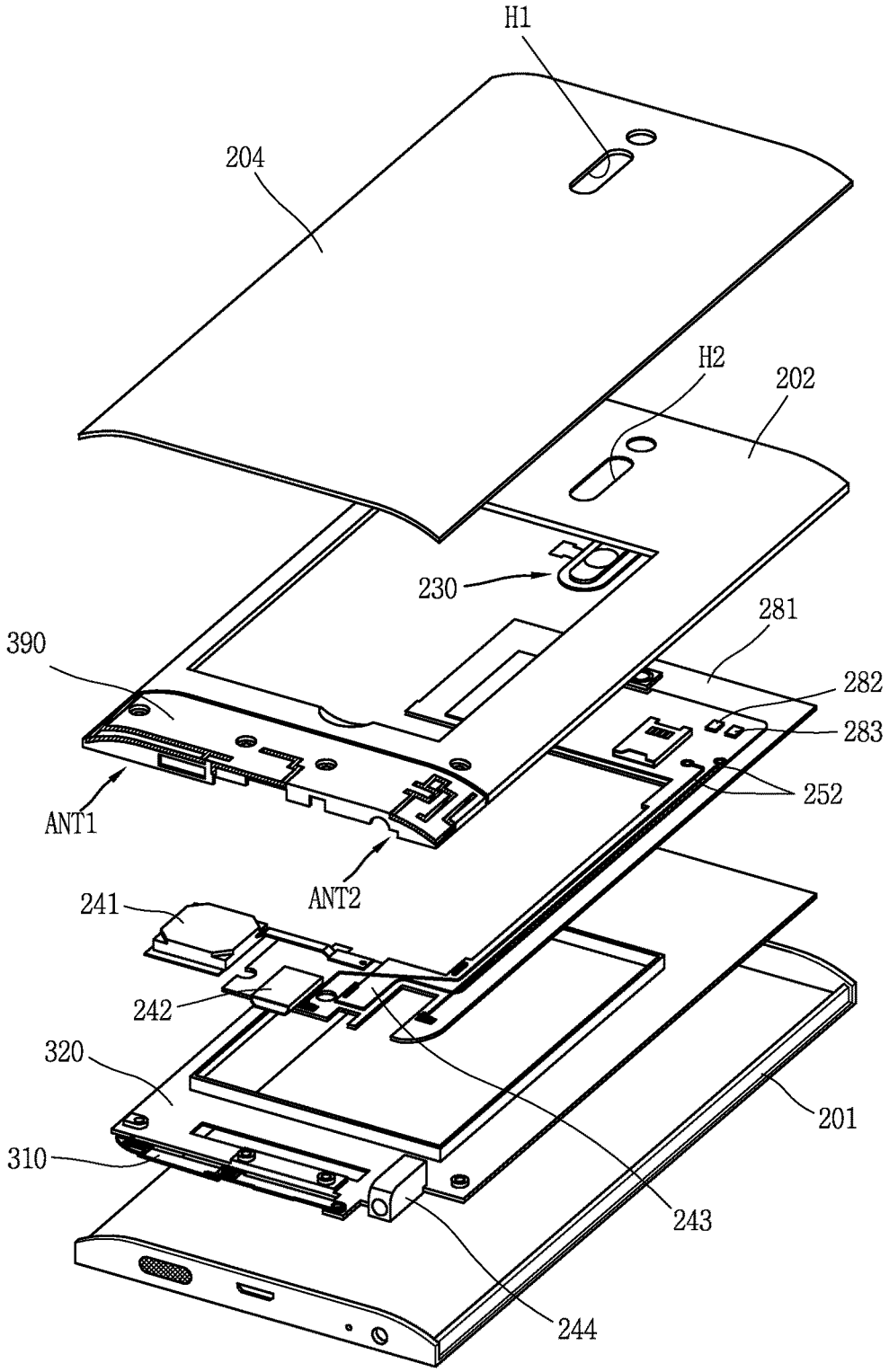
FIG. 4 is a disassembled perspective view of the mobile terminal illustrated in FIG. 3B.

FIG. 4 is a disassembled perspective view of the mobile terminal illustrated in FIG. 3B.

As illustrated in FIG. 4, a printed circuit board (PCB) 281 is mounted in a terminal body. The PCB 281 may be mounted on, for example, the front case 201 or the rear case 202, or mounted on a separate structure. The separate structure may construct an intermediate case. Hereinafter, description will be given under assumption that the front case 201 and the rear case 202 are separately configured, but the present invention may not be limited to this. Those cases 201 and 202 may also be integrally formed with each other.

The PCB 281 is configured as one example of the controller 180 (see FIG. 1) for operating various functions of the mobile terminal. The PCB 281 may be provided in plurality to perform functions of the controller 180 by combinations thereof. To perform those functions, various electronic elements are mounted on the PCB 281.

Also, the PCB 281 is electrically connected to antenna apparatuses ANT1 and ANT2, and process wireless signals corresponding to radio electromagnetic waves transmitted and received through the antenna apparatuses ANT1 and ANT2. The antenna apparatuses ANT1 and ANT2 are located between a structure and the PCB 281 to transmit and receive wireless signals through the rear case 202.

The PCB 281 may be electrically connected to the camera module 221' (see FIG. 3B). A battery receiving portion for receiving a battery therein is formed in the rear case 202, and a battery cover 204 for covering the battery receiving portion may be coupled to the rear case 202.

Also, via holes are formed through the rear case 202 and the battery cover 204, respectively, such that the camera module 221' can be disposed to face the exterior through the via holes. The camera module 221' is configured to capture external images through the rear surface of the terminal.

Regarding the rear input unit 230 again, in order to prevent a formation of a groove on a side surface of the terminal body in the lengthwise direction due to the rear input unit 230, the rear input unit 230 overlaps the display unit 251 in a thickness direction of the terminal body so as to be exposed to the rear surface other than the side surface.

The rear input unit 230 may be disposed between the camera module 221' and the battery. The rear input unit 230 may be located at a position where it overlaps the display unit 251 (see FIG. 3A) disposed on the front surface of the terminal body. This may allow such an input element to be located on the rear surface of the display unit 251. However, the present invention may not be limited to this, and the location of the rear input unit 230 may change. As illustrated, the battery cover 204 is provided with a through hole H1 corresponding to the rear input unit 230. Also, the rear case 202 may be provided with a through hole H2 corresponding to the through hole H1.

A first antenna apparatus according to an embodiment disclosed herein is an antenna transformed from a slot antenna, and is configured to resonate at a plurality of frequency bands for transmission and reception of wireless signals. In general, a slot antenna has a slot on a wall surface of a waveguide, a surface of a cylindrical conductor or a flat conductive plate, and feeds a portion with the slot to generate an electric field in the slot. Accordingly, the slot antenna operates as a radiator for electric waves. The typical slot antenna has been used for processing wireless signals of a single frequency band, but has not been used for processing wireless signals of plural frequency bands. This is because antenna impedance matching at each frequency band is performed at about 50Ω (ohm) and thereby the impedance matching at different frequency bands is difficult.

An antenna apparatus according to an embodiment disclosed herein is configured such that a first radiator which resonates along with a slot is connected to a member limiting (or defining) the slot so as to resonate at a plurality of frequency bands. Hereinafter, this will be described in more detail with reference to the accompanying drawings.

Figure 5:
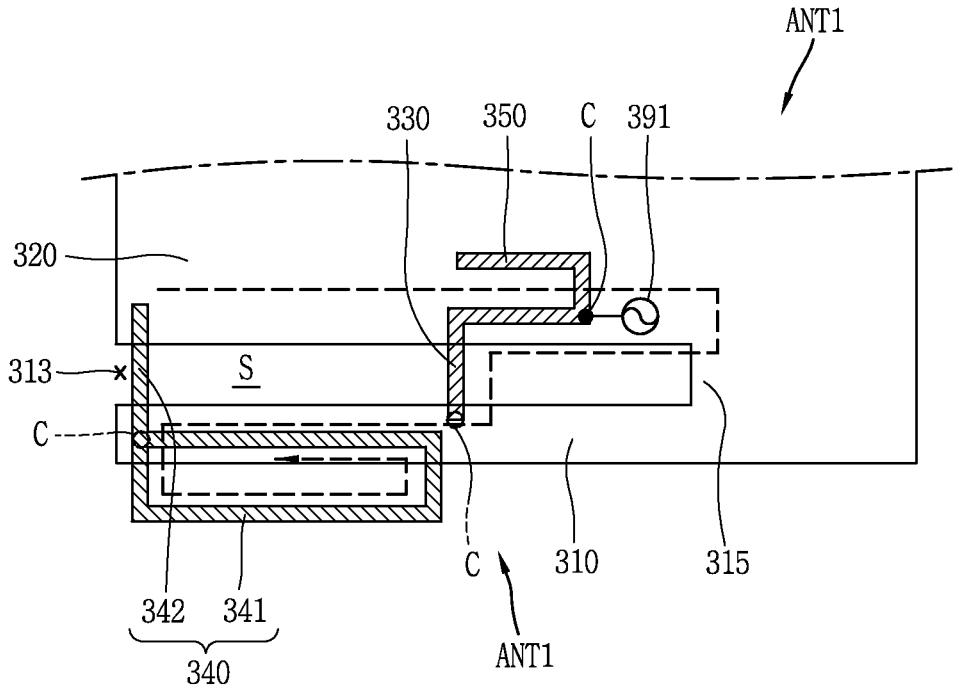
FIG. 5 is a conceptual view of a first antenna apparatus in accordance with one exemplary embodiment of the present invention.
Figure 6:
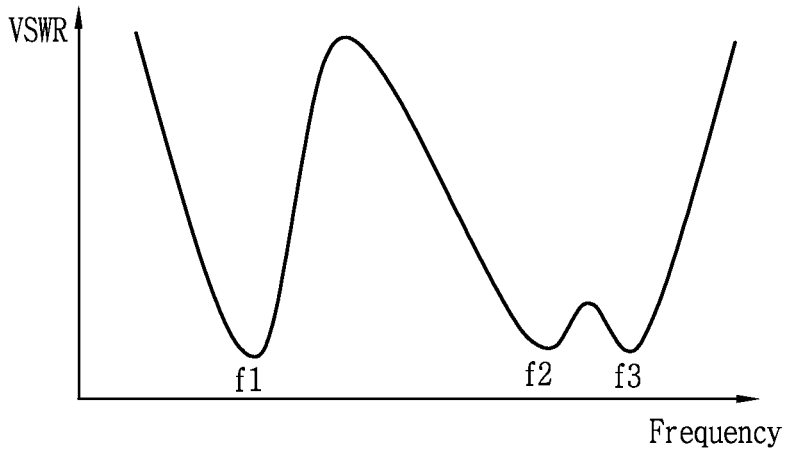
FIG. 6 is a view illustrating voltage standing wave ratios (VSWRs) of the antenna apparatuses illustrated in FIG. 5.

FIG. 5 is a conceptual view of a first antenna apparatus in accordance with one exemplary embodiment of the present invention. FIG. 6 is a view illustrating a voltage standing wave ratio (VSWR) of the antenna apparatus illustrated in FIG. 5. FIG. 5 is a conceptual view illustrating a configuration of an antenna apparatus. It will be understood that a shape or position of each member constructing the antenna apparatus may change when the antenna apparatus is actually mounted in a mobile terminal. Therefore, the antenna apparatus illustrated in FIG. 5 is illustrated slightly different in shape from the antenna apparatus illustrated in FIG. 4 or 9.

The radiation of the wireless signal by the antenna is performed over the entire main body of the terminal but mainly performed in a radiator or a slot. Therefore, for the sake of explanation, description will be given hereinafter under assumption that the radiator or the slot is configured to radiate a wireless signal at a specific frequency.

As illustrated in FIG. 5, a first antenna apparatus ANT1 may include a first member 310, a second member 320, a feeding unit 330 and a first radiator 340. The first antenna apparatus ANT1 may further include a second radiator 350. A part marked with dashed lines in FIG. 5 illustrates the flow of current along each member.

The first member 310 and the second member 320 may be configured as conductive members. The first member 310 and the second member 320 limit (define) a slot S of the antenna apparatus. That is, an empty space between the first member 310 and the second member 320 is the slot S. Here, for the sake of brief explanation, an open portion of the slot S is referred to as an opening 313, and a closed portion due to connecting the first member 310 and the second member 320 is referred to as a connecting portion 315.

A length of the slot S may vary by a feeding method of the antenna, a dielectric constant of a dielectric constructing the antenna, an addition of a capacitor formed in the feeding unit 330, or the like. Also, the antenna apparatus may have a smaller size in a manner that the slot S is curved at a specific partial portion thereof or formed in a Meander structure.

The slot S has a shape in which one side thereof is open and the other side is closed by the connecting portion 315 which connects the first member 310 and the second member 320 to each other. That is, the antenna apparatus according to the present invention has a slot with one side open. Such antenna may be configured to resonate at a low frequency band using a shorter slot by virtue of a mirror effect, compared with the slot antenna using a slot with both sides closed. That is, the slot antenna with the one side open may resonate at the same frequency band using a slot with about a half length (½) of the slot of the slot antenna with the both sides closed.

The slot S is required to have a width of at least 0.003λ times, considering antenna efficiency. As the width of the slot S increases more, the antenna apparatus can operate at a lower frequency band.

For the slot antenna with the both sides closed, in order to radiate an electric wave of a first frequency band, the slot has a length corresponding to λ/2 of a wavelength, which corresponds to a center frequency f1 of the first frequency band. On the other hand, the slot of the slot antenna with the one side open has a length corresponding to λ/4 of the wavelength of the center frequency. In other words, the slot antenna with the one side open can radiate an electric wave corresponding to a wireless signal of a low frequency band by using a shorter slot.

According to the present invention, the first radiator 340 is connected to one member limiting the slot S so as to resonate along with the slot at the first frequency band and a second frequency band. This may result in further reducing the length of the slot S.

The second frequency band indicates a higher frequency band than the first frequency band.

For example, when the center frequency of the first frequency band is 850 MHz, the slot of the slot antenna with the one side open has a length of 45 mm to 50 mm, which corresponds to λ/4 of the wavelength of the center frequency. However, the antenna apparatus according to the present invention has the first radiator 340, and thus can exhibit antenna efficiency sufficiently with a slot which is about 40 mm long, namely, has a length corresponding to 0.15λ of the wavelength of the center frequency. In this manner, since the antenna apparatus according to the present invention can exhibit the sufficient antenna efficiency with the slot having the shorter length, a mounting space for other components can be ensured when the antenna apparatus is mounted in a mobile terminal. This may result in a reduced size of the mobile terminal.

Figure 10:
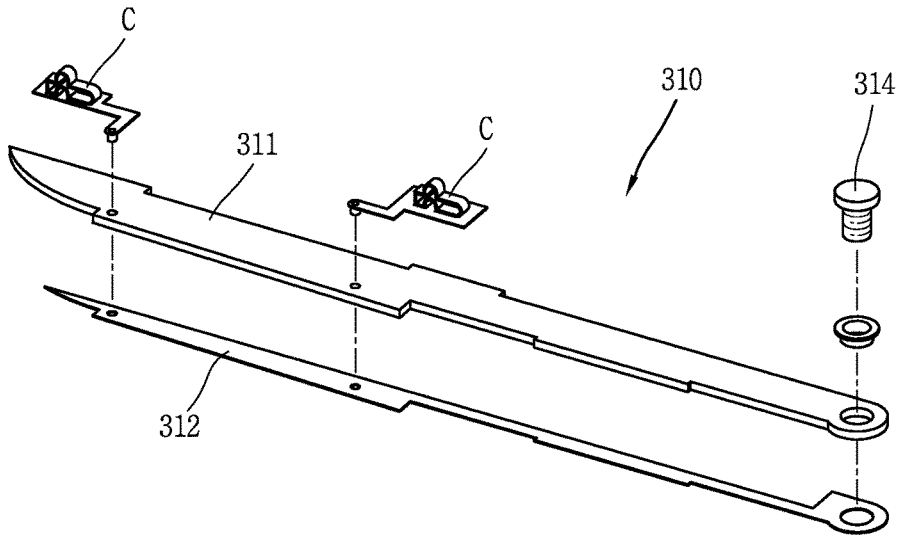
FIG. 10 is a disassembled perspective view illustrating one example of a first member constructing a first antenna apparatus.

The first member 310 and the second member 320 may be formed of any material if the material has conductivity. In this embodiment, the first member 310 has been configured as a flexible printed circuit board having a ground, and the second member 320 has been configured as a frame supporting an inside of the terminal. The first member 310 and the second member 320 may be electrically connected to each other. As illustrated in FIG. 10, the first member 310 may be coupled to the second member 320 using a screw.

The first member 310 and the second member 320 are conductive members provided in the terminal body, and may be configured as conductive members having the ground, such as the flexible printed circuit board, the printed circuit board or a metal frame.

The feeding unit 330 feeds the slot antenna such that the antenna apparatus can resonate at a specific frequency. In more detail, the feeding unit 330 may be configured such that one end thereof can be connected to one member limiting the slot so as to generate an electric field in the slot S.

The feeding unit 330 may be connected to all or at least part of the members according to a feeding method.

According to a direct feeding method, the feeding unit 330 which extends from a coaxial cable 252 (see FIG. 4) may extend from one member to the other member across the slot S. That is, according to the direct feeding method, one end of the feeding unit 330 may be connected to one member, and the other end thereof may extend up to the other member so as to be connected to the other member.

According to a coupling feeding method, one end of the feeding unit 330 may be connected to one member, and the other end thereof may be spaced apart from the other member.

The feeding unit 330 may be located at a position spaced from the connecting portion 315 by a predetermined distance, namely, a position where impedance of the center frequency of the first frequency band is about 50Ω due to the feeding unit 330. Also, the feeding unit 330 may include a shunt element which is provided with a capacitor and an inductor for impedance matching. The shunt element may adjust resistance which is a rear number part of impedance. For example, the inductor increases the resistance and the capacitor lowers the resistance so as to enable tuning for impedance matching. The shunt element may be configured as a lumped constant element at one end of the feeding unit 330.

Feeders 391 and 392 each may include a feeding unit and a matching unit. The feeding unit may be configured by a combination of a balun, a shifter, a distributor, a damper, an amplifier and the like. The matching unit may be implemented as serial elements or shunt elements. When implemented as the serial elements, reactance as an imaginary part of impedance may change. As one example, the inductor may increase the reactance and the capacitor may lower the reactance so as to change impedance of a specific frequency band. On the other hand, when implemented as the shunt elements, the resistance as the real number part of the impedance may change. As one example, the inductor may increase the resistance and the capacitor may lower the resistance so as to change impedance of a specific frequency band.

The mobile communication terminal may communicate with wireless base stations using wireless communications. For example, a cellular phone may perform communication using cellular telephone bands of 850 MHz, 900 MHz, 1800 MHz and 1900 MHz (for example, global system for mobile communications (GSM) or GSM cellular phone bands). Also, the mobile terminal can perform communication at a frequency band ranging from 1.92 to 2.17 GHz for wideband code division multiple access (WCDMA) services. In addition, the mobile terminal can perform communication at a frequency band ranging from 704 MHz to 960 MHz for B13 or B17 communication services of long term evolution (LTE).

Specifically, the first antenna apparatus ANT1 should be allowed to perform communication at those wireless communication frequencies. Hence, the antenna apparatus according to the embodiment of the present invention may further use a resonant frequency to expand bandwidths at a high frequency band.

To this end, the first antenna apparatus ANT1 may include a second radiator 350 that is configured to resonate at a third frequency band.

The second radiator 350 may be branched off from the feeding unit 330. In other words, one side of the second radiator 350 may be electrically connected to the feeding unit 330. The second radiator 350 is configured to resonate at the third frequency band which is adjacent to the second frequency band. For example, when the first radiator 340 which resonates together with the slot resonates at the first and second frequency bands, the second radiator 350 may have a corresponding length so as to resonate at the third frequency band. Accordingly, a high frequency band of the frequency bands of the first antenna apparatus ANT1 may extend from a center frequency of the second frequency band up to a center frequency of the third frequency band.

As illustrated in FIG. 6, when the center frequency of the second frequency band is 1.7 GHz, the center frequency of the third frequency band may be 2.1 GHz. On the other hand, when the center frequency of the second frequency band is 2.1 GHz, the center frequency of the third frequency band may be 1.7 GHz. The second radiator 350 may be length-adjustable so as to radiate a wireless signal at the center frequency. Also, the length or width of the slot may change to correspond to the lengths of the radiators. As the lengths of the radiators increase, the antenna apparatus can operate at a lower frequency band. Also, as the width or length of the slot increases, the antenna apparatus can operate at a lower frequency band.

The first radiator 340 may include a first part 341 at least part of which is parallel to the slot, and a second part 342 at least part of which intersects with the slot. The change in the length of the first part 341 may affect the shift of center frequencies f1 and f2 of the first and second frequency bands, and the change in the length of the second part 342 may affect the center frequency shift of the first frequency band.

The at least part of the second radiator 350 is configured to be in parallel to the feeding unit 330, which may allow the second radiator 350 to have a more reduced length. This results from capacitive coupling from the feeding unit 330. The capacitive coupling may arouse an increase in capacitive reactance of the antenna. When the capacitive reactance value increases, input impedance by the capacitance is inversely proportional to a frequency. Thus, a resonant frequency is reduced. The reduction of the resonant frequency indicates that the antenna apparatus includes the capacitive coupling and thus can have a more reduced length so as to operate at a lower frequency band. That is, if the antenna apparatus includes capacitively-coupled members, the antenna apparatus can operate at a low frequency band within a narrower space.

Figure 7:
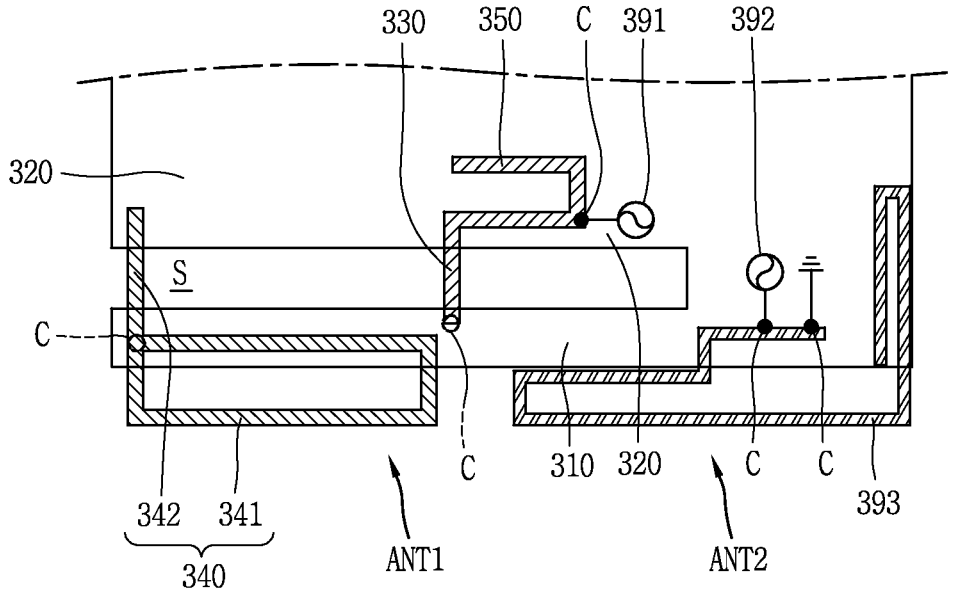
FIG. 7 is a conceptual view of first and second antenna apparatuses in accordance with one exemplary embodiment of the present invention.
Figure 8:
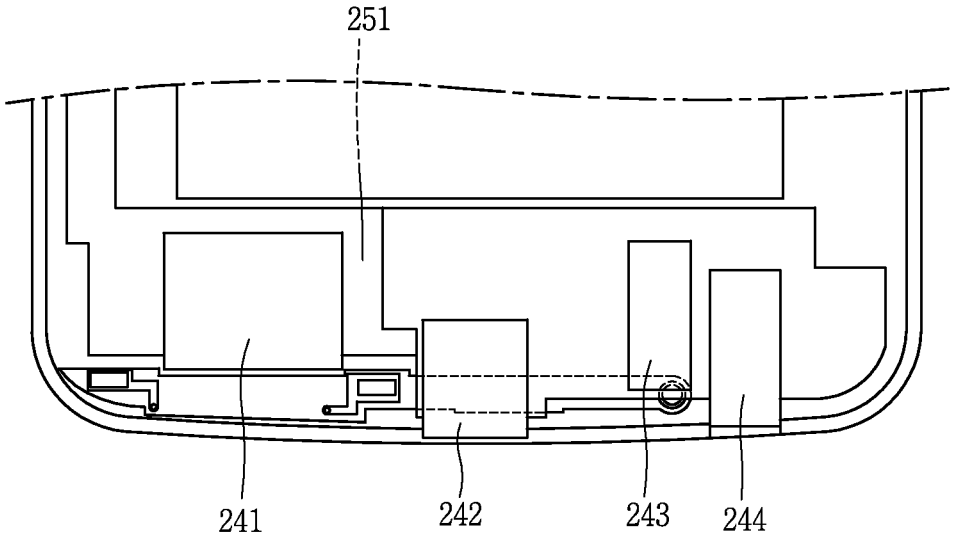
FIG. 8 is a conceptual view illustrating one example that antenna apparatuses and various components are mounted in a mobile terminal.

FIG. 7 is a conceptual view of first and second antenna apparatuses in accordance with one exemplary embodiment of the present invention. FIG. 8 is a conceptual view illustrating one example that antenna apparatuses and various components are mounted in a mobile terminal. FIGS. 7 and 8 are conceptual views illustrating a configuration of an antenna apparatus. It will be understood that a shape or position of each member constructing the antenna apparatus can change when the antenna apparatus is actually mounted in a mobile terminal. Therefore, the antenna apparatus illustrated in FIGS. 7 and 8 is illustrated slightly different in shape from the antenna apparatus illustrated in FIG. 4 or 9.

As illustrated in FIGS. 4 and 7, antenna apparatuses according to the embodiment of the present invention are provided with being spaced apart from each other on one side of the terminal body. In more detail, the first antenna apparatus ANT1 and the second antenna apparatus ANT2 are located on left and right sides of a lower portion of the terminal body.

Here, the feeding unit 330, the first radiator 340 and the second radiator 350 of the first antenna apparatus ATN1 and a radiator of the second antenna apparatus ANT2 may be formed as conductive patterns printed on one surface of a carrier 390, or formed on the PCB 281 of the terminal or a case defining an appearance of the terminal. The carrier 390 is a dielectric having a predetermined dielectric constant. The carrier 390 may be made of laminated paper impregnated with an epoxy resin binder (FR-3), and a compound with an epoxy resin impregnated paper core (CEM-1). Also, the surface of the carrier 390 may be made of epoxy resin-impregnated woven glass fiber. The core may use materials, such as epoxy resin impregnated non-woven glass fiber (CEM-3), epoxy resin impregnated glass fiber laminates (FR-4), multi-functional epoxy resin impregnated woven glass fiber laminates (FR-5), laminated woven glass fiber impregnated with polyimide resin (GI), and a part of the PCB.

The carrier 390 may have a predetermined width which is wide enough to come in contact with both side surfaces of the terminal body. For example, the carrier 390 may be accommodated in the front case in a contact state therebetween.

As aforementioned, the feeding unit 330, the first radiator 340 and the second radiator 350 of the first antenna apparatus ANT1 may be located at one side of the carrier 390, and the radiator of the second antenna apparatus ANT2 may be located at the other side of the carrier 390. Each of the antenna apparatuses ANT1 and ANT2 may be configured to transmit and receive signals of different frequency bands, or be configured to transmit and receive signals (data signal, MIMO, etc.) of the same frequency band.

For example, the first antenna apparatus ANT1 may be configured to transmit and receive DCN 1x or PCS 1x type signals, and the second antenna apparatus ANT2 may be configured to transmit and receive DCN evolution-data optimized or evolution-data only (EVDO) type signals.

Also, when the first antenna apparatus ANT1 transmits and receives LTE B4 type signals, the second antenna apparatus ANT2 may transmit and receive LTE B13 type signals.

On the other hand, when the first antenna apparatus ANT1 transmits and receives a signal corresponding to a voice service of the mobile terminal, the second antenna apparatus ANT2 may transmit and receive a data signal corresponding to an LTE service of the mobile terminal.

A flexible printed circuit board (FPCB) 245 (see FIG. 9) may be disposed below the carrier 390, and conductive members formed on the carrier 390 may be connected to the FPCB 245. The FPCB 245 may have one end connected to the PCB 281 having a controller. The FPCB 245 may be connected to a manipulation unit 231 (see FIG. 3A) of the terminal. In this instance, the FPCB 245 is configured in a manner that a signal generated in the manipulation unit 231 can be transferred to the controller of the PCB 281.

A transmission and reception circuit may be provided on the PCB 281 (see FIG. 4).

Here, the PCB may be an FPCB. A substrate may be a dielectric substrate or a semiconductor substrate. The substrate may have a ground on one surface thereof. When the substrate is a multi-layered substrate, one layer may be the ground. One end of a conductive member may be connected to the ground according to an antenna type.

The transmission and reception circuit may be provided in plurality, and each of the plurality of transmission and reception circuits may be implemented in the form of a communication chip which includes at least one of a call processor (CP), a modem chip, an RF transceiver chip, and RF receiver chip. Accordingly, each communication chip may transmit a wireless signal by feeding the conductive member through the feeding unit 330 and the matching unit, or receive a wireless signal received by the conductive member through the matching unit and the feeding unit 330 so as to perform a predetermined processing, such as frequency modulation or demodulation, for the received wireless signal.

Each of the transmission and reception circuits may be divided into a first communication chip 282 (see FIG. 4) and a second communication chip 283 (see FIG. 4). The first communication chip 282 may transmit or receive a wireless signal involved with the first antenna apparatus ANT1, and the second chip 283 may transmit or receive a wireless signal involved with the second antenna apparatus ANT2.

Here, each of the first antenna apparatus ANT1 and the second antenna apparatus ANT2 may be connected to the transmission and reception circuit through a transmission line 340. The transmission line 340 may be formed as a coaxial cable.

Accordingly, the first communication chip 282 and the second communication chip 283 may operate independent of each other such that the first communication chip 282 can process the signal involved with the first antenna apparatus ANT1, and the second communication chip 283 can process the signal involved with the second antenna apparatus ANT2. Therefore, the mobile terminal according to the embodiment of the present invention can reduce signal confusion and process signals belonging to different frequency bands in a more efficient manner.

In order to ensure smooth signal transmission and reception performance in a system with a MIMO or diversity-based antenna, mutual coupling and envelope correlation coefficient (ECC) should be lowered between a primary antenna (a main antenna of a transmitter or a receiver) and a secondary antenna (a sub antenna of a receiver in a diversity or MIMO system).

For example, the antenna may well operate as the MIMO antenna at an LTE frequency band when it meets required reception conditions, namely, that the main antenna operates equal to when using a single receiver, a gain difference between two antennas is smaller than 6 dB, the ECC is smaller than 0.5, the transmitter always uses the main antenna, an antenna to antenna isolation is greater than 8 dB, and the like.

Excluding the fundamental performance of the antenna such as gain and bandwidth from those requirements, it is the most difficult to meet the condition that the ECC indicating the correlation between two antennas should be 0.5 or less, in implementing the MIMO antenna in a mobile terminal.

To meet the condition, it is necessary that two antennas are spaced from each other by a distance of an half wavelength or more, or polarization directions of the two antennas are orthogonal to each other as much as possible. However, 4G mobile communication, namely, LTE, uses a frequency band of 700 MHz. Here, the length of the half wavelength sometimes exceeds 400 mm. Accordingly, it may actually be difficult that the two antennas are isolated from each other by a distance of the half wavelength or more in the mobile terminal.

Specifically, the antenna apparatuses of the mobile terminal disclosed herein are isolated from each other by 200 mm or less, and thus it is difficult for the antenna apparatuses to meet the antenna to antenna isolation.

The mobile terminal according to the embodiment of the present invention is configured such that the first antenna apparatus ANT1 is provided with a slot and the second antenna apparatus ANT2 is implemented as a planar inverted F antenna (PIFA) type antenna. With the configuration, even if those antenna apparatuses are adjacent to each other, the condition that the antenna to antenna isolation is −15 dB or less can be met.

This may result from that the first antenna apparatus ANT1 is provided with the slot so as to generally radiate a transverse magnetic wave and the second antenna apparatus ANT2 is the PIFA type antenna so as to generally radiate a transverse electric wave. Here, the general radiation refers to that each antenna apparatus can radiate both of the transverse magnetic wave and the transverse electric wave but one of those waves is radiated more strongly than the other.

As described above, by implementing the first and second antenna apparatuses ANT1 and ANT2 with such configurations, various devices within the terminal body can be compactly arranged. FIG. 8 illustrates an example of a mounted state of various components in the mobile terminal. For example, the antenna apparatuses are mounted on a rear surface of the display unit 251, in a manner of being located adjacent to or covering at least some of a speaker 241, an ear jack 244 and various elements (for example, an integrated chip 243).

Figure 9:
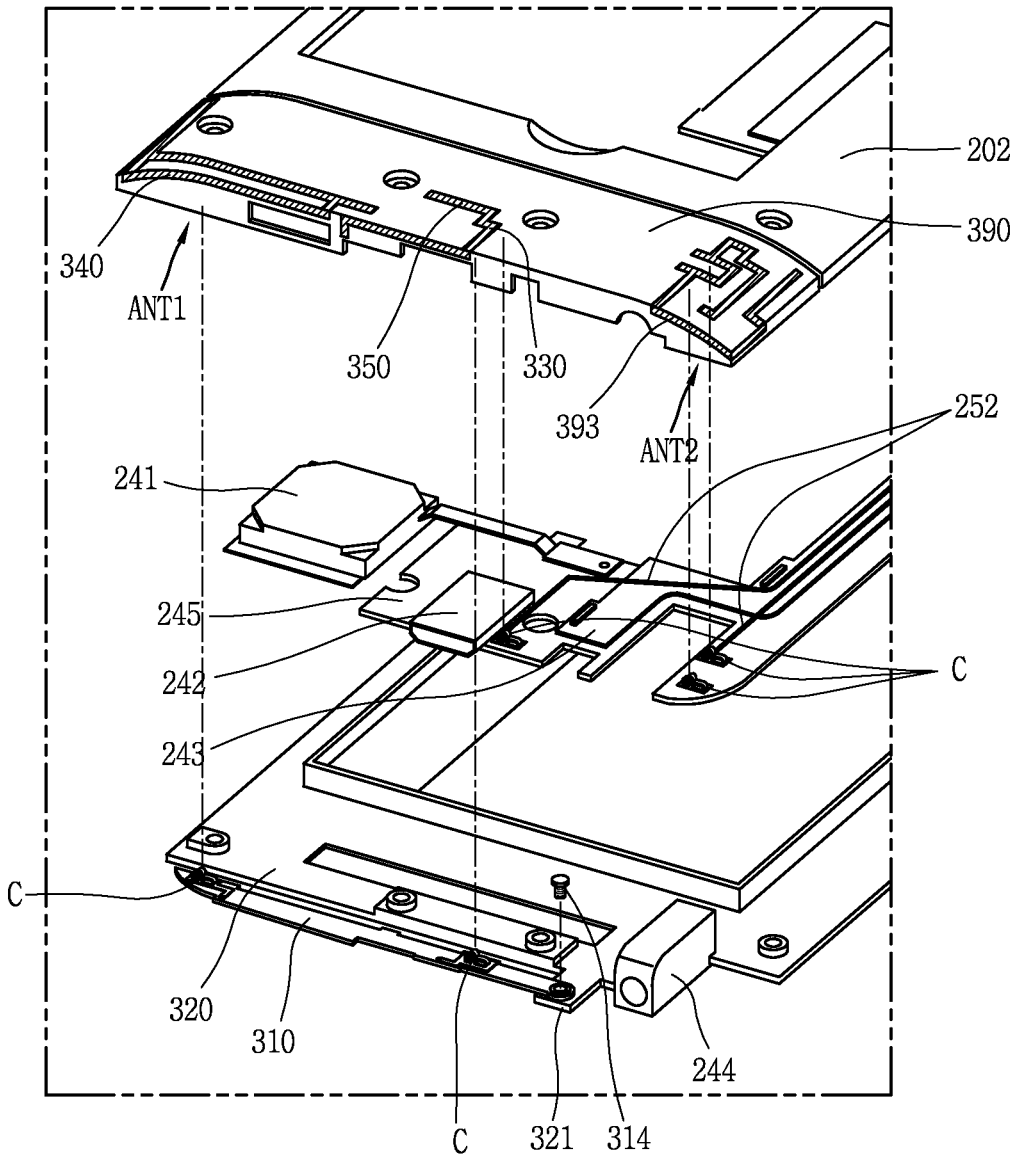
FIG. 9 is a disassembled perspective view of one side of a mobile terminal at which antenna apparatuses are disposed.
Figure 11A:
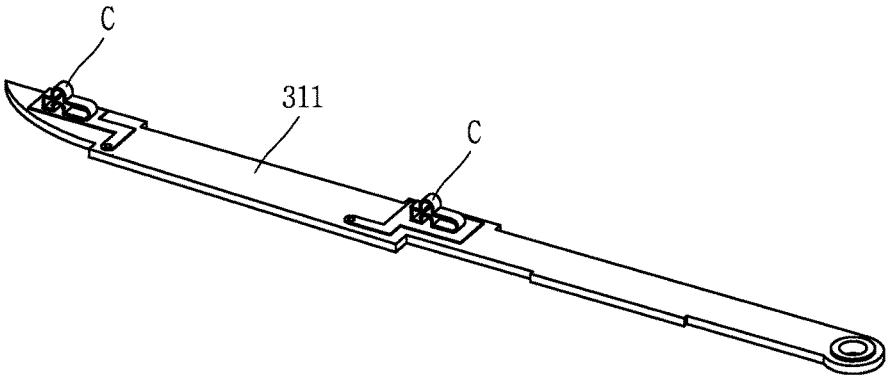
FIGS. 11A and 11B are views illustrating front and rear surfaces of the first member illustrated in FIG. 10.
Figure 11B:
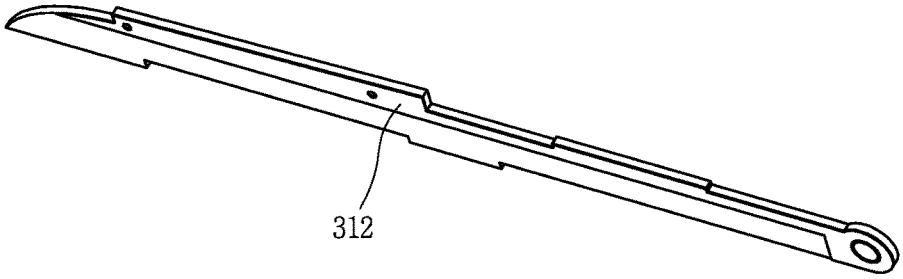

FIG. 9 is a disassembled perspective view of one side of a mobile terminal on which antenna apparatuses are disposed. FIG. 10 is a disassembled perspective view illustrating one example of the first member 310 constructing the first antenna apparatus ANT1. FIGS. 11A and 11B are views illustrating front and rear surfaces of the first member 310 illustrated in FIG. 10.

As illustrated in FIG. 9, the feeding unit 330, the first radiator 340 and the second radiator 350 of the first antenna apparatus ANT1 may be provided on one side of the carrier 390, and the radiator of the second antenna apparatus ANT2 may be provided on the other side of the carrier 390. The rear case 202 may be configured to have a predetermined dielectric constant so as to function as the carrier.

The FPCB 245 having a socket 242 may be disposed at a position where it can be covered by the carrier 390, and the first and second members 310 and 320 may be disposed below the FPCB 241. The first member 310, as will be explained later, may be provided with a conductive plate 312 disposed on a rear surface thereof to operate as a ground. The second member 320 may be a conductive frame 320 which is configured to support an inside of the terminal body. The conductive frame 320 may support the PCB 281, the battery 290 and the display unit 251 (see FIG. 3A).

The first member 310 and the second member 320 may be coupled to each other by a coupling element such as a screw 314. As illustrated in FIG. 9, the screw 314 may be inserted through a protruding portion 321 of the second member 320 and the first member 310 such that the second member 320 and the first member 310 can be coupled to each other. Accordingly, the first member 310 and the second member 320 may be electrically connected to each other. When the first member 310 and the second member 320 are electrically connected to each other, the conductive plate 312 on the rear surface of the first member 310 may be electrically connected to the second member 320.

As illustrated in FIGS. 7 and 9, the second antenna apparatus ANT2 is the PIFA type antenna. Thus, the radiator 393 may have one side fed and the other side grounded. The fed one side and the grounded other side of the radiator 393 may be connected to contact portions C through the carrier 390. The contact portions C which allow for the fed connection and the grounded connection of the radiator 393 of the second antenna apparatus ANT2 may be formed on the second member 320, or on one surface of the FPCB 245.

As illustrated in FIGS. 9 and 10, one side of the feeding unit 330 of the first antenna apparatus ANT1 may be inserted through the carrier 390 to be connected to the contact portion C formed on the second member 320. The contact portion C connected to the one side of the feeding unit 330 may be formed on one surface of the FPCB 245 when the FPCB 245 is disposed on the second member 320, or formed on one surface of the second member 320.

The other side of the feeding unit 330 may be connected to the first member 310 through the carrier 390. To this end, the carrier 390 may be provided with via holes formed through upper and lower surfaces thereof.

The contact portions C may connect different conductive members to each other electrically or in an electro-magnetic (EM) feeding manner. The contact portions C may be formed on the members, respectively. To this end, each of the contact portions C may include at least one of a conductive plate, a conductive clip or a conductive wire. Here, the conductive plates, the conductive clips and the conductive wires of the respective contact portions C may be electrically connected to each other so as to transfer a fed current (or voltage) to the conductive members which transmit and receive the wireless signals. Here, the conductive wire may include a microstrip printed on a substrate. The embodiment of the present invention has used a C-clip as the conductive clip.

As illustrated in FIGS. 9 and 10, the contact portions C may be exposed in a state that the FPCB 245 and the first and second members 310 and 320 are laminated on one another. That is, the FPCB 245 is disposed not to cover the contact portions C formed on the first member 310. Accordingly, the contact portions C may be connected to the first radiator 340 and the feeding unit 330, respectively, which are exposed to the rear surface of the carrier 390.

As illustrated in FIGS. 10 to 11B, the first member 310 may be configured as a dielectric 311 having upper and lower surfaces. The upper surface of the first member 310 may be disposed within the terminal body to be covered by the carrier 390 (see FIG. 9). Accordingly, when the plurality of contact portions C are formed on the upper surface of the first member 310, one side of each contact portion may be connected to the feeding unit 330 or the first radiator 340. Also, the conductive plate 312 may be coupled onto the lower surface of the first member 310 and operate as a ground of the antenna apparatus.

The other side of each contact portion C may be connected to the conductive plate 312 through the dielectric 311. For this, the dielectric 311 may be provided with via holes. Since the conductive plate 312 constructing the first member 310 limits the slot, the length and width of the slot may be decided according to the shape of the conductive plate 312.

The configurations and methods of the mobile terminal in the aforesaid embodiments may not be limitedly applied, but such embodiments may be configured by a selective combination of all or part of the embodiments so as to implement many variations.

Also, it will be understood by those skilled in the art which the present invention belongs to that the present features can be embodied in several forms without departing from the ideas or essential characteristics thereof.

Therefore, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

An antenna apparatus according to an embodiment of the present invention can be applied to a mobile terminal which provides wireless mobile communication services.

The invention claimed is:

1. An antenna apparatus comprising:

a first member and a second member limiting a slot;

a feeding unit provided on one surface of a carrier covering the slot and configured to feed the slot; and a first radiator formed on the one surface of the carrier with being spaced apart from the feeding unit, and electrically connected to the first member, the first radiator configured to resonate together with the slot at a first frequency band and a second frequency band, wherein one side of the feeding unit is inserted through the carrier to be connected to a contact portion that is formed in the second member, and the other side thereof is inserted through the carrier to be connected to the first member, and wherein the first member comprises a dielectric having contact portions on an upper surface that is covered by the carrier and a conductive plate positioned below a lower surface of the dielectric.

2. The antenna apparatus of claim 1, wherein one side of the slot is open.

3. The antenna apparatus of claim 2, wherein the first radiator comprises a first part having at least part in parallel to the slot, and a second part having at least part intersecting with the slot.

4. The antenna apparatus of claim 3, wherein the length of the slot corresponds to 0.15λ of a center frequency (λ) of the first frequency band.

5. The antenna apparatus of claim 1, wherein one of the contact portions provided at the first member is connected to the feeding unit.

6. The antenna apparatus of claim 5, wherein the other of the contact portions provided at the first member is connected to the first radiator.

7. The antenna apparatus of claim 1, further comprising a second radiator branched off from the feeding unit such that the antenna apparatus additionally resonates at a third frequency band.

8. The antenna apparatus of claim 7, wherein at least part of the second radiator is in parallel to the feeding unit.

9. A mobile terminal comprising:

a terminal body; and a first antenna apparatus and a second antenna apparatus provided on one side of the terminal body with being isolated from each other, wherein the first antenna apparatus comprises:

a first member and a second member limiting a slot;

a feeding unit provided on one surface of a carrier covering the slot and configured to feed the slot; and a first radiator formed on the one surface of the carrier with being spaced apart from the feeding unit, and electrically connected to the first member, the first radiator configured to resonate together with the slot at a first frequency band and a second frequency band, wherein one side of the feeding unit is inserted through the carrier to be connected to a contact portion that is formed on the second member, and the other side thereof is inserted through the carrier to be connected to the first member, and wherein the first member comprises a dielectric having contact portions on an upper surface that is covered by the carrier and a conductive plate positioned below a lower surface of the dielectric.

10. The mobile terminal of claim 9, wherein the second antenna apparatus is implemented as a planar inverted F antenna (PIFA) type antenna.

11. The mobile terminal of claim 10, wherein the first antenna apparatus generally radiates transverse magnetic waves and the second antenna apparatus generally radiates transverse electric waves.

12. The mobile terminal of claim 9, wherein the first and second members are conductive members provided on the terminal body, respectively.

13. The mobile terminal of claim 9, wherein one side of the slot is open.

14. The mobile terminal of claim 13, wherein the first radiator comprises a first part having at least part in parallel to the slot, and a second part having at least part intersecting with the slot.

15. The mobile terminal of claim 14, wherein the length of the slot corresponds to 0.15λ of a center frequency (λ) of the first frequency band.

16. The mobile terminal of claim 9, wherein one of the contact portions provided at the first member is connected to the feeding unit.

17. The mobile terminal of claim 16, wherein the other of the contact portions provided at the first member is connected to the first radiator.

18. The mobile terminal of claim 9, wherein the contact portions provided at the first member are electrically connected to the conductive plates through via holes formed through the first member.

19. The mobile terminal of claim 9, wherein the first antenna apparatus further comprises a second radiator branched off from the feeding unit such that the first antenna apparatus additionally resonates at a third frequency band.

20. The mobile terminal of claim 19, wherein at least part of the second radiator is in parallel to the feeding unit.

21. The mobile terminal of claim 9, wherein the second member is a flexible printed circuit board that is mounted in the terminal body and configured to transfer signals input and output through a socket to a controller, the socket allowing for an access with an external device.

22. The mobile terminal of claim 21, further comprising a conductive frame that is mounted in the terminal body and configured to support an inside of the terminal body, wherein the conductive plate and the conductive frame are electrically connected to each other.

* * * * *